US008172001B2

(12) United States Patent
Tow et al.

(10) Patent No.: US 8,172,001 B2
(45) Date of Patent: May 8, 2012

(54) PENDENT RESIDENTIAL FIRE PROTECTION SPRINKLERS

(75) Inventors: John P. Tow, Easley, SC (US); Oliver S. Pahila, Simpsonville, SC (US); Charles R. Watson, Seneca, SC (US)

(73) Assignee: The Reliable Automatic Sprinkler Co., Inc., Elmsford, NY (US)

( * ) Notice: Subject to any disclaimer, the term of this patent is extended or adjusted under 35 U.S.C. 154(b) by 172 days.

(21) Appl. No.: 12/187,275

(22) Filed: Aug. 6, 2008

(65) Prior Publication Data

US 2009/0078432 A1 Mar. 26, 2009

Related U.S. Application Data

(60) Provisional application No. 60/954,072, filed on Aug. 6, 2007.

(51) Int. Cl.

| | |
|---|---|
| ***A62C 37/08*** | (2006.01) |
| ***A62C 37/36*** | (2006.01) |
| ***A62C 37/12*** | (2006.01) |
| ***B05B 1/26*** | (2006.01) |

(52) U.S. Cl. ..... 169/38; 169/37; 169/42; 169/57; 169/58; 239/498; 239/504; 239/518

(58) Field of Classification Search ..... 169/37, 169/38, 39, 41, 42, 57, 58; 239/498, 518, 239/461, 504

See application file for complete search history.

(56) References Cited

U.S. PATENT DOCUMENTS

| | | | | |
|---|---|---|---|---|
| 2,697,008 | A * | 12/1954 | Rowley | 239/498 |
| 5,865,256 | A * | 2/1999 | Pounder | 169/37 |
| 6,026,907 | A * | 2/2000 | Pahila | 169/37 |
| 6,059,044 | A * | 5/2000 | Fischer | 169/37 |
| 6,276,460 | B1 * | 8/2001 | Pahila | 169/37 |
| 6,516,893 | B2 * | 2/2003 | Pahila | 169/37 |

* cited by examiner

*Primary Examiner* — Len Tran
*Assistant Examiner* — Ryan Reis
(74) *Attorney, Agent, or Firm* — Fitzpatrick, Cella, Harper & Scinto

(57) ABSTRACT

A pendent residential fire prevention sprinkler has a frame structure extending from the sprinkler body, and a system for blocking an outlet to prevent fluid from passing through the outlet until occurrence of a predetermined condition and for unblocking the outlet in response to occurrence of the condition. A deflector is supported by the frame structure at a predetermined distance from the outlet, at a position to be impinged upon by the fluid leaving the outlet. The deflector has a central portion and a peripheral portion, and slots formed in the periphery, defining tines therebetween. The slots include a first plurality of slots, each of which extends inward from the deflector periphery with a uniform width, a second plurality of slots, each of which has a first portion and a second portion between the deflector periphery and the slot's closed end, where the first portion has a width that varies at different points, while the second portion has a uniform width.

13 Claims, 5 Drawing Sheets

*Fig. 5*

F1 RES 76 Flows and Pressures

Pendent/Recessed Pendent for 0.05 Density

| Spacings (ft x ft) | Area x Density = (sq. ft x gpm/sq. ft) = | Min. Flows (gpm) | Flows and Pressures | | | | |
|---|---|---|---|---|---|---|---|
| | | | RASCO gpm (psi) K-Factor = 7.6 | RASCO gpm (psi) K-Factor = 5.8 | TYCO gpm (psi) K-Factor = 6.9 | VIKING gpm (psi) K-Factor = 7.4 | VICTAULIC gpm (psi) K-Factor = 6.9 |
| 20 x 20 | 400 x .05= | 20 | 23 (9.2) | 22 (14.4) | 22 (10.2) | 24 (10.5) | 22 (10.2) |
| 18 x 18 | 324 x .05 = | 17 | 21 (7.6) | 19 (10.8) | 19 (7.6) | 22 (8.8) | 20 (8.4) |
| 16 x 16 | 256 x .05 = | 13 | 21 (7.6) | 16 (7.6) | 19 (7.6) | 20 (7.3) | 20 (8.4) |
| 14 x 14 | 196 x .05 = | 10 | 21 (7.6) | 16 (7.6) | 19 (7.6) | 20 (7.3) | 20 (8.4) |
| 12 x 12 | 144 x .05 = | 8 | 21 (7.6) | 16 (7.6) | 19 (7.6) | 20 (7.3) | 20 (8.4) |

Pendent/Recessed Pendent for 0.1 Density

| Spacings (ft x ft) | Area x Density = (sq. ft x gpm/sq. ft) = | Min. Flows (gpm) | Flows and Pressures | | | | |
|---|---|---|---|---|---|---|---|
| | | | RASCO gpm (psi) K-Factor = 7.6 | RASCO gpm (psi) K-Factor = 5.8 | TYCO gpm (psi) K-Factor = 6.9 | VIKING gpm (psi) K-Factor = 7.4 | VICTAULIC gpm (psi) K-Factor = 6.9 |
| 20 x 20 | 400 x .1 = | 40 | 40 (27.7) | 40 (47.6) | 40 (33.6) | 40 (29.2) | 40 (33.6) |
| 18 x 18 | 324 x .1 = | 32.4 | 32.4 (18.2) | 32.4 (31.2) | 32.4 (22.0) | 32.4 (19.2) | 32.4 (22.0) |
| 16 x 16 | 256 x .1 = | 25.6 | 25.6 (11.3) | 25.6 (19.5) | 25.6 (13.8) | 25.6 (12.0) | 25.6 (13.8) |
| 14 x 14 | 196 x .1 = | 19.6 | 21 (7.6) | 20 (11.9) | 20 (8.4) | 20 (7.3) | 20 (8.4) |
| 12 x 12 | 144 x .1 = | 14.4 | 21 (7.6) | 16 (7.6) | 19 (7.6) | 20 (7.3) | 20 (8.4) |

PENDENT RESIDENTIAL FIRE PROTECTION SPRINKLERS

RELATED APPLICATION

This application claims benefit under 35 U.S.C. §119(e) of A.N. 60/954,072, filed 6 Aug. 2007, the entire disclosure of which is hereby incorporated herein by reference.

BACKGROUND OF THE INVENTION

1. Field of the Invention

The present invention relates to pendent residential fire protection sprinklers, and relates more particularly to pendent residential fire protection sprinklers suitable for the protection of even relatively large residential spaces, through having the ability to provide the required coverage of even a large space with the required evenness and required throughput (flow, measured, e.g., in gallons per minute) at relatively low water pressures. The invention also relates to residential fire protection systems utilizing such sprinklers.

2. Related Art

Fire protection sprinklers conventionally are connected to a conduit to receive pressurized fire-extinguishing fluid, such as water. A typical sprinkler has a base with a threaded portion for connection to the conduit and an output orifice to output the fluid to provide fire control and/or suppression. The output orifice is sealed by a seal cap, which is held in place by a release mechanism. The release mechanism is designed to release the cap under predetermined conditions, thereby initiating the flow of fire-extinguishing fluid. A typical release mechanism includes a thermally-responsive element, e.g., a frangible bulb, and may include a latching mechanism.

Certain conventional sprinklers have a pair of arms that extend from the base portion and meet at a hub portion to form a frame. The hub portion is spaced apart from the output orifice of the base portion and lies on the longitudinal axis thereof (the axis, roughly, along which the stream of fluid flows through the orifice). The hub portion may have a setscrew configured to apply a pre-tension force to the thermally-responsive element and latching mechanism. A deflector may be mounted on the hub, transverse to the output orifice, to provide dispersion of the output fluid.

Fire protection sprinklers may be mounted on a fluid conduit running along a ceiling and may either depend downward from the conduit, which is referred to as a "pendent" configuration, or may extend upward, which is referred to as an "upright" configuration. The area to be protected may extend across an entire room, in which case the relevant fire protection standards, e.g., Underwriters' Laboratories® Standard 1626 (the substance of which is incorporated herein by reference in its entirety), require the fluid flow to reach the four walls surrounding the coverage area, and to impinge on the coverage area evenly, among other requirements. (The true application of these sprinklers having larger K-factors is for 0.1 density, per NFPA 13. NFPA 13D—one and two family dwellings (0.05 density, 2-head design for hydraulic calculation); NFPA 13R—residential occupancies up to and including 4 stories in height (0.05 density, 4-head design for hydraulic calculation); NFPA 13—residential occupancies greater than four stories in height (0.1 density, 4-head calculation); these standards, also, are incorporated herein by reference.) To provide a sprinkler that meets these requirements for residential installations is especially difficult, because the available water pressure in residences is generally below what can be utilized in a commercial space. To this end, it is desired to increase the ability of the sprinkler to deliver fluid per unit time, as a function of available water pressure. This ability is generally measured by the K factor of the sprinkler, defined as the ratio of the fluid throughput per unit time in gallons per minute, to the square root of the water pressure in gauge pounds per square inch.

In addition to achieving the ability to spray fluid at the required rate, a sprinkler must also meet certain standards pertaining to the evenness with which that fluid is delivered over the surfaces of the space being protected.

Both of these requirements make the design of a residential sprinkler a challenge. Moreover, although data has been compiled and tabulated on the characteristics of sprinklers based on K factor and the water pressure used, it is frequently found that an actual sprinkler does not perform as predicted based on the known data. Frequently, it is found that a sprinkler requires a higher-than-expected water pressure to deliver an acceptable amount of fluid per minute.

As a result, the task of designing a sprinkler having a given K factor and that not only will provide the required coverage but will do so at a particular water pressure, is a very challenging one. Depending on the particular parameters that it is desired to achieve, there is no guarantee in fact that it will actually be possible to create a design that will provide the desired level of performance.

SUMMARY OF THE INVENTION

The present inventors have provided a new residential pendent sprinkler having an unexpectedly high K factor, and that operates with excellent results at an unexpectedly low water pressure.

In one aspect of the invention, a pendent residential fire prevention sprinkler has a frame structure extending from the sprinkler body, and a system for blocking an outlet to prevent fluid from passing through the outlet until occurrence of a predetermined condition and for unblocking the outlet in response to occurrence of the condition. A deflector is supported by the frame structure at a predetermined distance from the outlet, at a position to be impinged upon by the fluid leaving the outlet. The deflector has a central portion and a peripheral portion, and slots formed in the periphery, defining tines therebetween. The slots include a first plurality of slots, each of which extends inward from the deflector periphery with a uniform width, a second plurality of slots, each of which has a first portion and a second portion between the deflector periphery and the slot's closed end, where the first portion has a width that varies at different points, while the second portion has a uniform width.

Another aspect of the invention is a pendent residential fire prevention sprinkler has a frame structure extending from the sprinkler body, and a system for blocking an outlet to prevent fluid from passing through the outlet until occurrence of a predetermined condition and for unblocking the outlet in response to occurrence of the condition. A deflector is supported by the frame structure at a predetermined distance from the outlet, at a position to be impinged upon by the fluid leaving the outlet. The deflector has a central portion and a peripheral portion, and slots formed in the periphery, defining tines therebetween. In this aspect of the invention, the residential fire sprinklers each provide a fluid flow of 40 gallons per minute at a gauge fluid pressure of 27.7 psi.

Another aspect of the invention is a residential fire protection system utilizing such sprinklers.

BRIEF DESCRIPTION OF THE FIGURES

FIG. 5 presents, in tabular form, the results of tests that were performed, comparing the performance of the embodiment of FIG. 1 with that of some commercially available residential sprinklers.

DESCRIPTION OF THE PREFERRED EMBODIMENT

Figure 1:
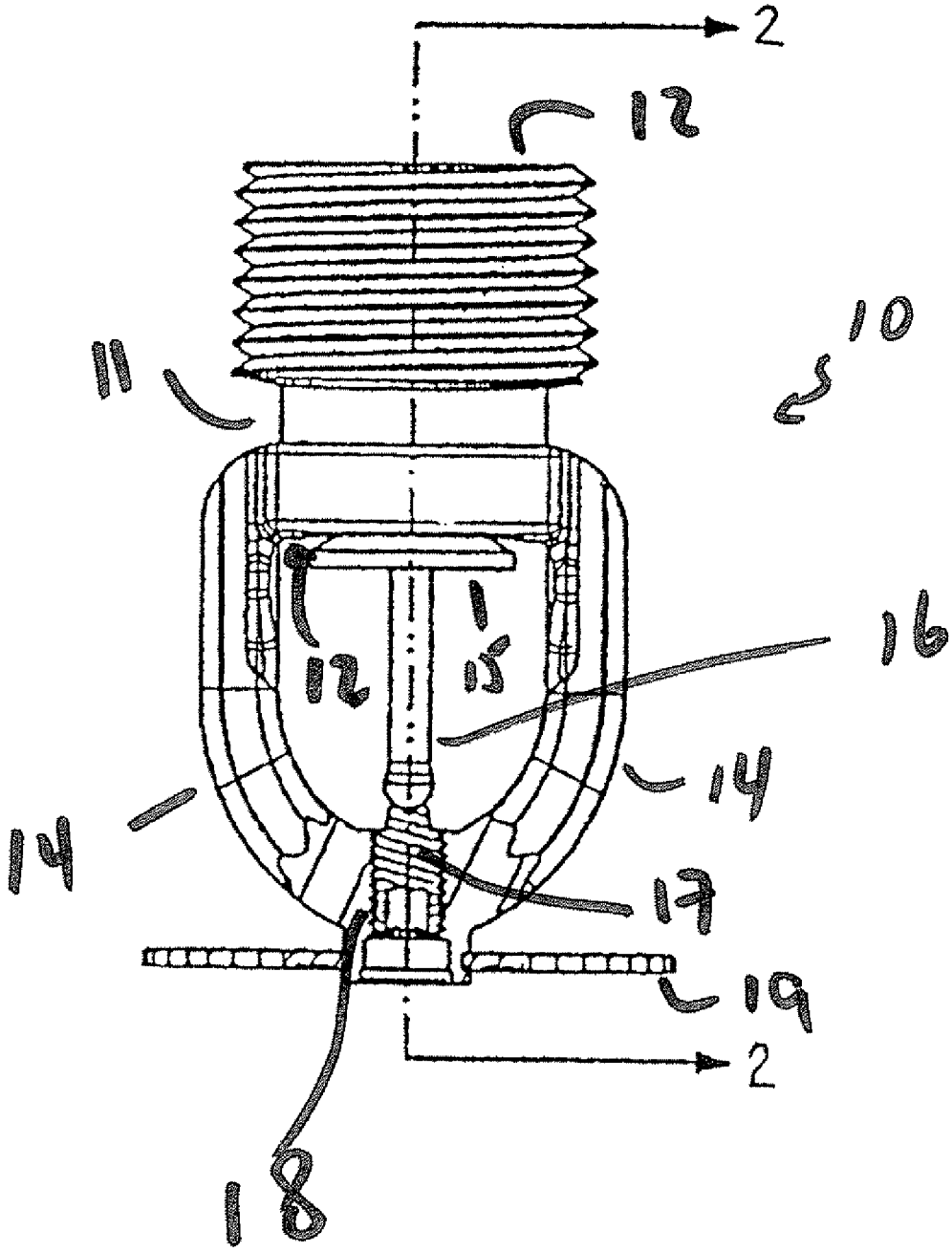
FIG. 1 is a side view, partly in section, of a first embodiment of the present invention.

In one aspect, the present invention provides a pendent fire protection sprinkler 10, shown in FIG. 1. Since the major parts of the preferred embodiment are common to many sprinklers, it is not deemed necessary to describe them in full detail (reference may be had to U.S. Pat. No. 6,516,893, assigned in common herewith, for additional views).

Figure 2:
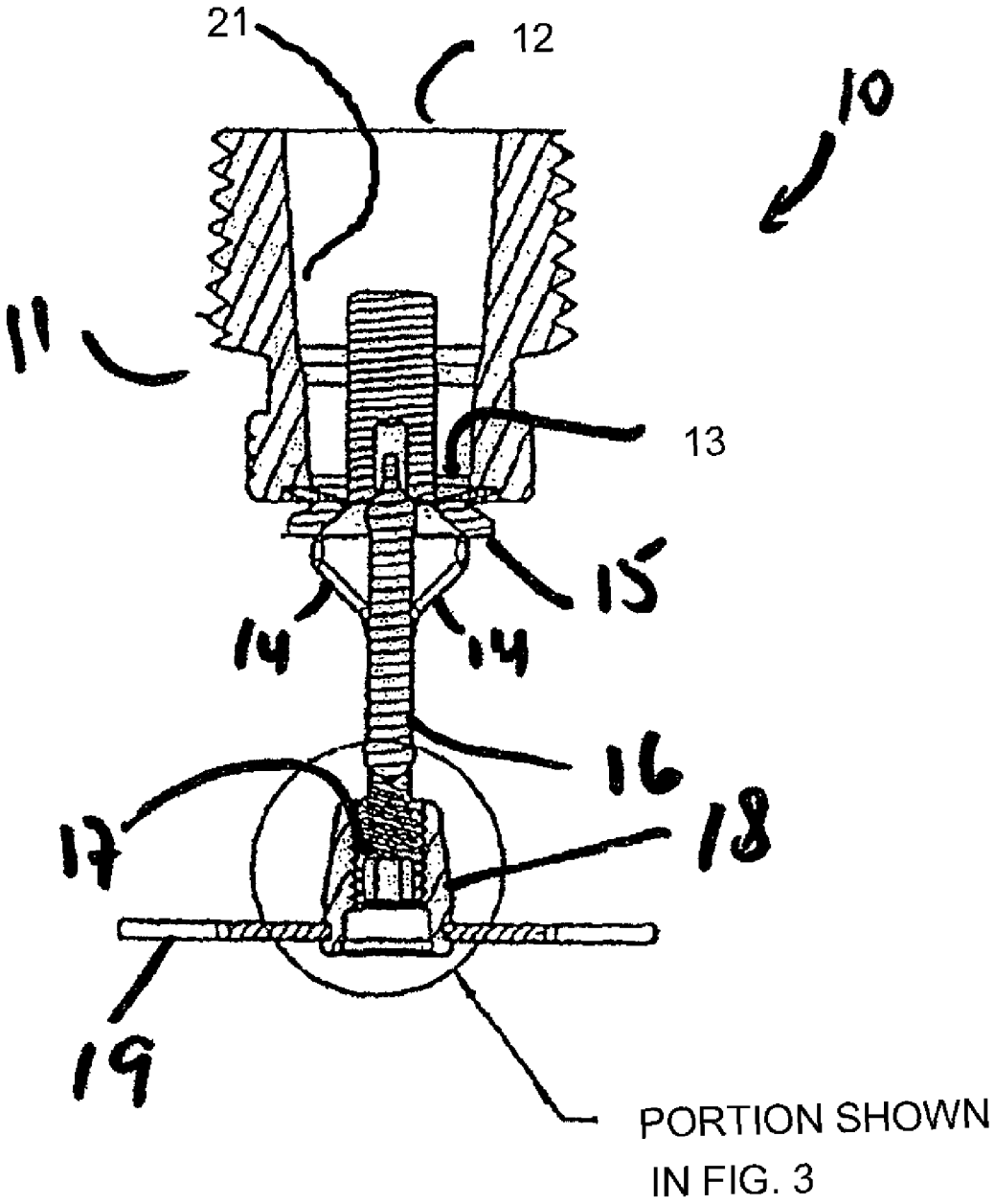
FIG. 2 is a sectional view of that embodiment, taken from section line 2-2 in FIG. 1.

The sprinkler 10 of this embodiment has a body 11 having an inlet orifice 12, an output orifice 13 and an axial passage 21 (see FIG. 2) through the body joining the inlet and outlet orifices. The exterior of the body adjacent the inlet 12 is threaded, to permit the sprinkler to be connected to a piping system that delivers a fire extinguishing fluid to the sprinkler. That fluid is often water, and for simplicity, the fluid will generally be referred to hereinafter as being water; it should nonetheless be understood that other fluids can be substituted without departing from the scope of the invention. The pendent sprinkler 10 is installed with the inlet 12 upwards, and the rest of the sprinkler depending therefrom. It is within the invention for the sprinkler 10 to be mounted either with a cover or exposed to view; both arrangements are well known, and do not require description.

Two co-planar frame arms 14 extend from the sprinkler body 11, and are joined together at a distance from the body 11. A seal cap 15 blocks the outlet 13 so as to prevent the flow of any fluid from the output orifice 13, and a thermally-responsive element 16 holds the cap 15 in place. Element 16, which may be for example a glass container in which is a thermally-responsive liquid that upon being heated sufficiently will cause the glass to break, has one end positioned against the cap 15, and its other end supported by a load screw 17 that is mounted in a hub 18 that is supported by the frame arms 14. (The load screw and the hub are together referred to as a "hub assembly" for convenience herein.) The thermally-response element 16, cap 15 and hub assembly together serve to block the outlet 13, until occurrence of a sufficient temperature condition to cause element 16 to break as described above. When this occurs, as is well known, the cap 15 is no longer held in place, and the water pressure in the piping system and gravity remove the cap, allowing the water to issue from the outlet 13. (This can be visualized most easily from FIG. 2.)

The sprinkler 10 also includes a deflector 19 supported by and below the frame arms 14. The deflector 19 of the sprinkler 10 is, broadly, a disc, as can be appreciated more easily from FIG. 4. The deflector 19 has an upper face and a lower face. When the sprinkler is actuated, the stream of water emerging under pressure from the outlet 13 first impinges upon the exposed tip of the load screw and hub, and then onto the upper face of the deflector 19. The deflector is structured (as described below) to disperse the water so as to achieve the required flow, distributed properly over the area protected by the sprinkler. The load screw tip and the hub direct the flow of water onto the deflector, and in fact, thereby play a key role in the proper operation of the sprinkler. This is because directing the stream of water so that it impinges on precisely the right portion of the deflector has been found by the inventors to be of great importance in achieving the best possible distribution of water over the protected area. The preferred embodiment of the present invention has a K factor of 7.6 or more.

The inventors have found that to achieve the desired coverage, with the desired evenness, a number of features and relationships among parts are important to critical. The deflector 19 must have the correct total area, and it is necessary to be sure that the water strikes the deflector 19 with the proper velocity. Also, it has been found that it is necessary for the water to impinge on the deflector 19 not only with the right velocity, but also in the right location. Furthermore, to achieve proper coverage of the area to be protected, it is not possible to use a deflector having a conventional structure; rather, the deflector 19 itself must have a number of unconventional features, as described below.

In the preferred embodiment, the load screw tip is sized, shaped and positioned so as to create a spread in the column of fluid from the orifice onto a disk-shaped area of the correct diameter in the middle of the deflector 19. It has been found that controlling the size of this area is very important in achieving the desired operational characteristics at the low pressures for which the present sprinkler is intended to be suitable. Moreover, it has been found that the spacing between the outlet orifice 13 and the deflector 19 influences the velocity with which the fluid impinges on the deflector, and is important in achieving an even distribution of the fluid onto the walls of the space without the fluid being deflected up onto the ceiling.

Figure 3:
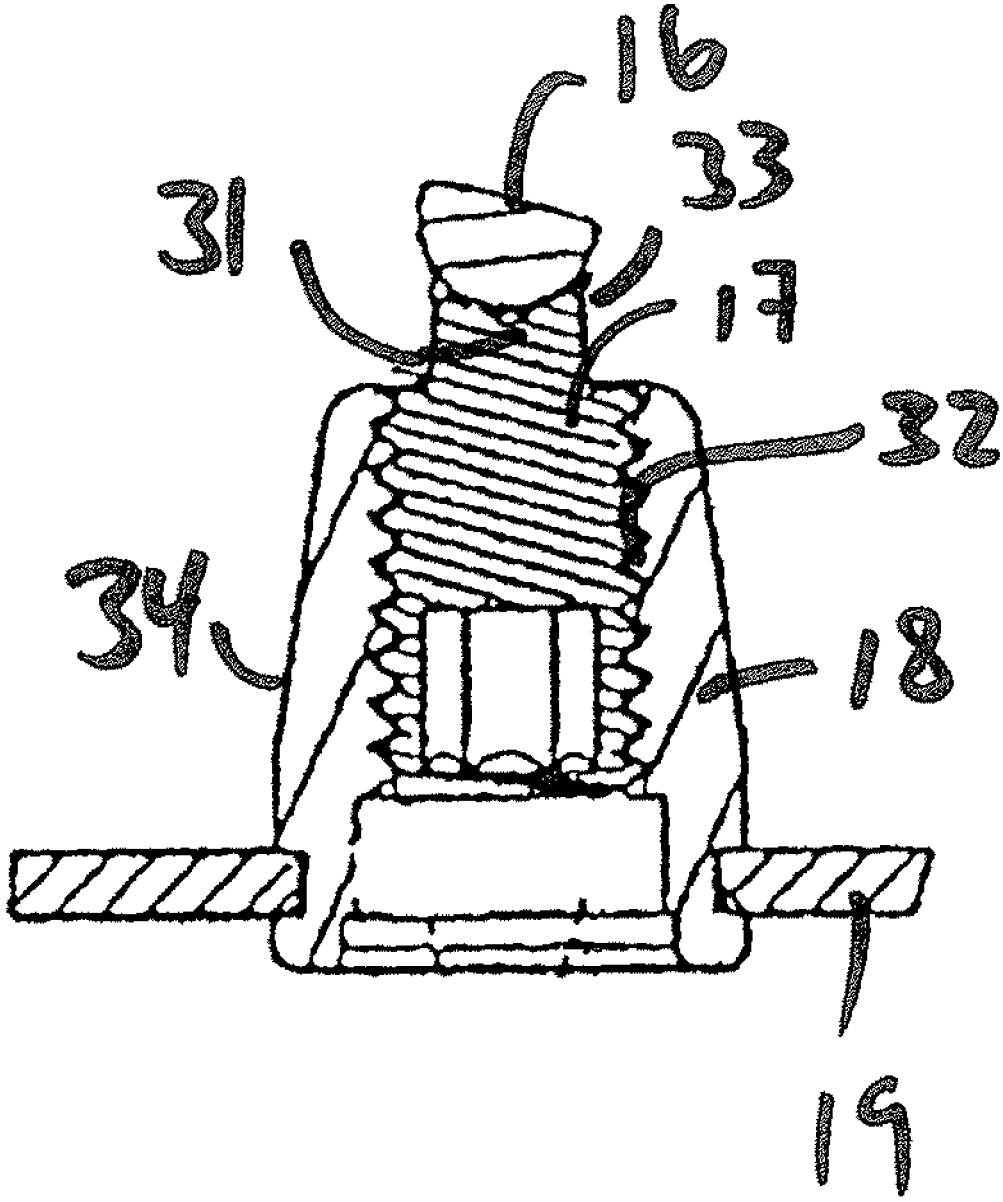
FIG. 3 is a detail, in section, of the circled portion of the structure shown in FIG. 2.

FIG. 3 shows an enlarged view, partly in section, of the hub assembly. The lower end of the thermally-responsive element 16 is visible, resting on the upper tip 31 of the load screw 17. The load screw 17 is threaded into a central bore 32 in the hub 18. The inventors have obtained optimum results with the tip 31 of the load screw 17 protruding a certain distance (in the preferred embodiment, 0.075 inch) from the upper surface of the hub 18, and with the lateral sides 33 at a slight angle (8.5° in the preferred embodiment) to the axis of the sprinkler 10 (that axis being the line extending from the center of the outlet orifice 13 to the center of the deflector 19). The upper surface of the tip should not be excessively small (in the preferred embodiment it is 0.108 inch). Moreover, the hub 18 itself plays an important role, and the size of its upper surface greatly factors into reduction of water column's dispersion (and its energy or velocity) (this surface in the preferred embodiment has a diameter of 0.285 inch). The same consideration applies to the cross-sectional width of the frame arms 14 at the zone of their convergence with the screw hub 18 (the frame arms are here teardrop-shaped in cross-section).

The lateral sides 34 of the hub 18 are sloped at a slight angle to the sprinkler axis (in the preferred embodiment, 8.5°). It is not necessary for the entire height of the lateral wall 34 to be sloped, and in the preferred embodiment this slope is provided to the upper 0.285 inch of wall 34. Finally, the upper edge of the hub 18, where the lateral sides 34 meet the top surface, should not present a sharp edge to the water flow, but should be radiused (again, a radius of 0.04 inch is used in the preferred embodiment).

Figure 4:
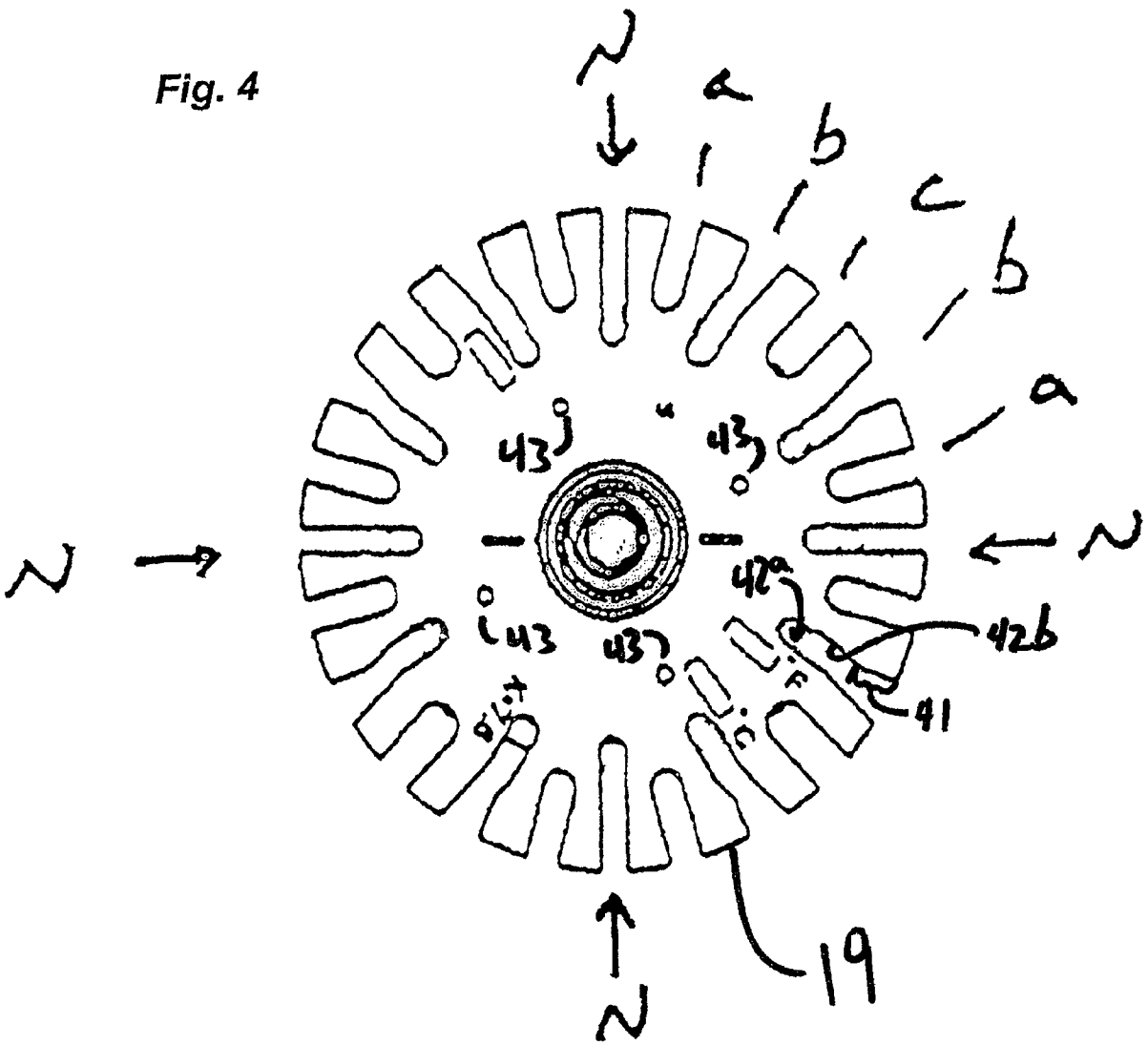
FIG. 4 is a view end-on of the deflector of the embodiment of FIG. 1.

Also, to achieve delivery of the proper amounts of fluid to the walls and to the floor of the area to be protected, and with the correct distribution as between the walls and the floor, the deflector 19 has a number of features that are not conventional. It is known to provide the deflector with slots formed in its circumference, but the present deflector 19 uses slots differing from conventional arrangements in a number of ways, as shown in FIG. 4. While conventional slots are formed exactly radially, the present deflector is provided with a first group of four slots N that are not exactly radial. These four slots are distributed 90° apart from each other around the circumference, two of them being in the plane defined by the frame arms 14 and the other two lying in a plane perpendicular thereto. These slots N are unconventional in that they deviate from being exactly radial, by a small amount. These slots N also are unconventional in that they are provided with a small amount of chamfering at their edges, on the surface of the deflector 19 that faces toward the floor (the side opposite the outlet orifice 13).

Moreover, a number of other slots are formed in such a way as to define four structures resembling a bent fork (defined by slots c and the tines adjoining those slots), each of which is located about 45° from one of the non-radial slots N. These structures are particularly important in ensuring that the fluid is delivered all the way into the corners of the space that is being protected, which is especially difficult when the sprinkler must operate with a low water pressure.

As can be seen in the drawing, the various slots each have a shape from a total of four different shapes. Taking the relatively deep slot at a location N as a starting point and going counterclockwise, one encounters a relatively wide but shallow (or short) slot a, then a deep and asymmetrical slot b, a slot c that is the widest and also (by a small margin) the shallowest of the four shapes, then another slot of the same shape as slot b, and another having the same shape as slot a. This pattern of six slots is repeated a total of four times around the circumference of the deflector, once in each 90° of the circumference.

The asymmetrical slots b have an outer portion 41 in which the slot width decreases from the deflector periphery, and then an inner portion 42, in which the width is constant. This inner portion in addition includes both a region 42*a* where the direction of the slot is radial, but also another region 42*b* where the slot b extends in a direction that is visibly at an angle to the radius of the deflector 19.

Thus, one feature of the deflector 19 is that it has a first plurality of slots (slots a, c and N), which are each of constant width (although they are not all of the same width), and which extend at least approximately radially toward the center of the deflector (although not exactly, in the case of slots N), and a second plurality of slots, which each have a portion that is visibly non-radial, as well as a portion that is of variable width (slots b).

In addition, the root diameter of all four shapes of slots (the width of the slot at its closed end nearest the center of the deflector) is relatively large.

In the preferred embodiment, the deflector 19 has a diameter of 1.56 inches. The length of slots N is 0.305 inch, and their width is 0.065 inch. Slots a are 0.23 inch in length and 0.08 inch in width, and slots c are 0.22 inch in length and 0.10 inch in width. The asymmetrical slots b have a total depth (distance from the deflector periphery to the root of the slot) of 0.3175 inch. Region 42*a*, nearest the deflector center, has a length of 0.118 inch (not including the length of the radiused closed end), and a width of 0.07 inch, region 42*b* extends at an angle of 12.5° to the deflector radius, out to a distance of 0.10 inch from the deflector periphery, and has a width of 0.07 inch, and portion 41 has occupies the last 0.10 inch out to the periphery and has a width that increases linearly.

Also, in the preferred embodiment, the angular spacing from a slot of type N to the nearest slot b is 32.5°, measured from the center of slot N at the deflector periphery to the radius that intersects the center of the root of slot b. The angular spacing from a slot N to the nearest slot a is 15°, measured from the center of slot N at the deflector periphery to the radius that lies on the nearest edge of slot a, and that from slot N to the nearest slot c is 45.0°, measured from the center of slot N at the periphery of the deflector 19 to the center of slot c.

In addition to the slots, the deflector 19 is provided with a number of small holes 43 (four in the drawing) that permit additional delivery of fluid to the floor beneath the sprinkler. In the preferred embodiment, these four holes are countersunk, having a larger bore on the lower side of the deflector and a smaller bore on the upper surface. In the preferred embodiment, the holes 43 have a diameter of 0.045 inch on the upper side of deflector 19, and a maximum diameter of 0.078 inch on the lower side (the counterbore, on the under side of the deflector, is preferably formed with its wall at an angle of 60°).

The placement of these holes also is unconventional, in that such holes would commonly be placed in line with the frame arms, or along a line perpendicular to the location of the frame arms, while in the present invention, they are placed somewhat offset from the conventional locations (and 90 degrees apart from each other). In the preferred embodiment, the holes 43 are 22.5° from the slots N, measured from the center of slot N at the deflector periphery to the radius that passes through the center of the hole 43. This placement also has been found to be important in achieving the desired operation.

These features of the deflector 19 help to ensure that the fluid is distributed in the desired way as between the floor and the walls of the space being protected, and that fluid is delivered into the corners of the space at a sufficient rate.

The attached drawings are to scale, and the contents of those drawings are part of the disclosure of the present invention.

It should also be noted that, while one preferred embodiment of the sprinkler is illustrated, it is also contemplated to use this sprinkler in a concealed version, employing a standard cup and cover plate.

FIG. 5 is a table showing an accurate comparison for 0.1 density (including data for a concealed sprinkler), comparing the preferred embodiment of the present invention (in the columns labeled "RASCO") with a number of other, conventional residential sprinklers (identified in the table by their respective manufacturers). In each column of data, the first number gives the water flow achieved in gallons per minute, and the second number (in parentheses) give the gauge pressure in pounds per square inch required for that flow.

These data show that the sprinkler of the present invention achieves the desired operation at lower pressures than can be used with the other sprinklers tested. As is well known, this is advantageous to the end user, since the lower pressure demand in the system reduces the installation cost.

What is claimed is:

1. A pendent residential fire prevention sprinkler comprising:

a sprinkler body, having an inlet and an outlet and an axial passage from said inlet to said outlet, said inlet being to receive in-flowing fire-extinguishing fluid and said outlet being to deliver the fluid from said body;

means for blocking and unblocking said outlet to prevent the fluid from passing through said outlet, said means being for blocking said outlet until occurrence of a predetermined condition and for unblocking said outlet in response to occurrence of the condition;

a frame structure extending from said sprinkler body; and a deflector, supported by said frame structure at a predetermined distance from said outlet, at a position to be impinged upon by the fluid leaving said outlet upon said outlet being unblocked, said deflector having a central portion and a peripheral portion, said peripheral portion having a number of slots extending from an open end, at the periphery of said deflector, generally toward said central portion, and each having a closed end, said slots including a first plurality of slots each of which extends inward from the periphery of said deflector with a first, uniform width between the periphery and said closed end of that slot, and said closed ends of said first plurality of slots narrowing from said first, uniform width to zero width, and said slots including a second plurality of slots each of which has a first portion and a second portion between the periphery of said deflector and said closed end portion of that slot, said first portion having a width that varies at different points within said portion, and said second portion having a uniform width, wherein said first portion is radially outward from said second portion from said central portion of said deflector.

2. A sprinkler in accordance with claim 1, further comprising a hub assembly supported at a position between said outlet and said central portion of said deflector and at a second predetermined distance from said outlet, whereby fluid leaving said outlet impinges on said hub assembly before impinging on said deflector, said hub assembly having a hub and having a tip that protrudes from said hub, and wherein said tip and said hub each have angled lateral surfaces.

3. A sprinkler in accordance with claim 2, wherein said hub assembly comprises a screw threadedly received in a central bore of said hub, and wherein said tip is a tip of said screw.

4. A pendent residential fire prevention sprinkler comprising:

a sprinkler body, having an inlet and an outlet and an axial passage from said inlet to said outlet, said inlet being to receive in-flowing fire-extinguishing fluid and said outlet being to deliver the fluid from said body;

means for blocking and unblocking said outlet to prevent the fluid from passing through said outlet, said means being for blocking said outlet until occurrence of a predetermined condition and for unblocking said outlet in response to occurrence of the condition;

a frame structure extending from said sprinkler body; and a deflector, supported by said frame structure at a predetermined distance from said outlet, at a position to be impinged upon by the fluid leaving said outlet upon said outlet being unblocked, said deflector having a central portion and a peripheral portion, said peripheral portion having a number of slots extending from an open end, at the periphery of said deflector, generally toward said central portion, and each having a closed end portion, said slots including a first plurality of slots each of which extends inward from the periphery of said deflector with a uniform width between the periphery and said closed end portion of that slot, and said slots including a second plurality of slots each of which has a first portion and a second portion between the periphery of said deflector and said closed end portion of that slot, said first portion having a width that varies at different points within said portion, and said second portion having a uniform width, wherein said first plurality of slots comprises three groups of slots, said slots of a first of said three groups having a first length and a narrow width, said slots of a second of said three groups having a second length and that is less than said first length and a width that is greater than said narrow width, and said slots of a third of said three groups having a length that is less than said length of said slots of said second group and a width that is greater than the widths of said slots of said first and second groups.

5. A sprinkler in accordance with claim 4, wherein said frame structure comprises two frame arms lying in a first plane that extends from said outlet to said hub assembly, and wherein two of said slots of said first group are located in said plane and two others of said slots of said first group are located in a plane perpendicular to said first plane, and wherein said second group of slots includes eight slots one of which is disposed to each side of each of said slots of said first group and spaced therefrom around the periphery of said deflector by an angle of 15°, and wherein said third group of slots includes four slots located between two slots of said second group of slots and equally space therefrom around the periphery of said deflector.

6. A sprinkler in accordance with claim 5, wherein each of said slots of said second plurality also has a third portion, in which that slot has a uniform width and in which said slot extends in toward said central portion of said deflector in a direction that does not lie on a radius of said deflector.

7. A sprinkler in accordance with claim 5, wherein said second plurality of slots includes eight slots each of which is located between a slot of said second group of slots and a slot of said third group of slots, at a location about 32.5° from a slot of said first group of slots.

8. A sprinkler in accordance with claim 1, having a K-factor of at least 7.0.

9. A sprinkler in accordance with claim 8, having a K-factor of at least 7.6.

10. A sprinkler in accordance with claim 1, where said deflector has a plurality of holes that pass through said deflector, each of said holes being spaced angularly by more than 10° and less than 80° from a slot of said second plurality of slots.

11. A sprinkler in accordance with claim 10, wherein said holes are angularly spaced about 22.5 from a slot of said second plurality of slots.

12. A fire protection system comprising a plurality of sprinklers in accordance with claim 1.

13. A residential fire protection system comprising:

a plurality of residential fires sprinklers having a K-factor of at least 7.0; and at least one conduit for delivering a fire extinguishing fluid to said sprinklers, wherein said residential fire sprinklers each comprise:

a sprinkler body, having an inlet and an outlet and an axial passage from said inlet to said outlet, said inlet being to receive in-flowing fire-extinguishing fluid and said outlet being to deliver the fluid from said body;

means for blocking and unblocking said outlet to prevent the fluid from passing through said outlet, said means being for blocking said outlet until occurrence of a predetermined condition and for unblocking said outlet in response to occurrence of the condition;

a frame structure extending from said sprinkler body; and a deflector, supported by said frame structure at a predetermined distance from said outlet, at a position to be impinged upon by the fluid leaving said outlet upon said outlet being unblocked, said deflector having a central portion and a peripheral portion, said peripheral portion having a number of slots extending from an open end, at the periphery of said deflector, generally toward said central portion, and each having a closed end portion, said slots including a plurality of slots each of which has a first portion and a second portion between the periphery of said deflector and said closed end portion of that slot, said first portion having a width that varies approximately linearly within said portion, decreasing from the periphery of said deflector, and said second portion having a uniform width and extending at an angle to a radius of said deflector that extends from that slot to said central portion of said deflector, wherein said first portion is radially outward from said second portion from said central portion of said deflector, and wherein said residential fire sprinklers each provide a fluid flow of 40 gallons per minute at a gauge fluid pressure of 27.7 psi.

* * * * *